US007633232B2

(12) United States Patent
Wong

(10) Patent No.: US 7,633,232 B2
(45) Date of Patent: Dec. 15, 2009

(54) ELECTRONIC CANDLE AND METHOD OF USE

(75) Inventor: Sau Man Wong, Stonyfell (AU)

(73) Assignee: SAP Products Limited, Dong Guan, Guang Dong (CN)

( * ) Notice: Subject to any disclaimer, the term of this patent is extended or adjusted under 35 U.S.C. 154(b) by 313 days.

(21) Appl. No.: 11/560,648

(22) Filed: Nov. 16, 2006

(65) Prior Publication Data

US 2008/0117634 A1 May 22, 2008

(51) Int. Cl.
*H05B 37/02* (2006.01)

(52) U.S. Cl. ..... 315/149; 315/156; 315/159; 315/307

(58) Field of Classification Search ..... 315/149–159, 315/209 R, 224, 247, 291, 294, 307–308, 315/312; 362/161, 227, 276, 392, 800, 810
See application file for complete search history.

(56) References Cited

U.S. PATENT DOCUMENTS

| | | | | |
|---|---|---|---|---|
| 4,328,534 | A | 5/1982 | Abe | |
| 4,492,896 | A | 1/1985 | Jullien | |
| 4,755,135 | A | 7/1988 | Kwok | |
| 4,839,780 | A | 6/1989 | Chuan et al. | |
| 5,660,209 | A | 8/1997 | Franz et al. | |
| RE37,168 | E | 5/2001 | St. Louis | |
| 6,616,308 | B2 | 9/2003 | Jensen et al. | |
| 6,808,297 | B2 | 10/2004 | Jensen et al. | |
| 6,880,958 | B2 | 4/2005 | Swarovski | |
| 6,926,423 | B2 | 8/2005 | Bucher et al. | |
| 6,981,786 | B2 | 1/2006 | Yao et al. | |
| 2002/0127945 | A1 * | 9/2002 | Cheng | 446/175 |
| 2005/0110417 | A1 * | 5/2005 | Li et al. | 315/149 |
| 2005/0253533 | A1 * | 11/2005 | Lys et al. | 315/224 |
| 2006/0197469 | A1 * | 9/2006 | Kim | 315/291 |
| 2007/0040513 | A1 * | 2/2007 | Cleland et al. | 315/159 |
| 2007/0086199 | A1 * | 4/2007 | Demarest et al. | 362/441 |
| 2007/0291483 | A1 * | 12/2007 | Lys | 362/227 |

* cited by examiner

*Primary Examiner*—David Hung Vu
*Assistant Examiner*—Tung X Le
(74) *Attorney, Agent, or Firm*—Hahn Loeser + Parks LLP; Scott M. Oldham

(57) ABSTRACT

A portable electronic light providing a light resembling a candle that can be turned off by blowing on the light or by generating other predetermined sounds. The electronic light comprises a sound sensor, one or more light emitting diodes, or LEDs, a light cover, a housing, and a circuit board. The circuit board includes an amplifier/demodulator circuit, a counter/oscillator circuit, a driver circuit, and a switching circuit. The sensor detects a low frequency created by blowing on the candle type light or other signal, in order to control the power circuit and turn off the light. The counter/oscillator circuit and the switching circuit cause the LEDs to turn on and off, simulating the flickering of a candle.

26 Claims, 8 Drawing Sheets

ELECTRONIC CANDLE AND METHOD OF USE

BACKGROUND

The present disclosure relates to the field of electronic candle type lights, and particularly to electronic candle type lights that can be turned off by sound, pressure or the like, created for example by simulated blowing of the candle out.

Electricity has become the typical power source for lighting. Electricity is used for lights such as large search lights, office and home lights, small light emitting diodes, and other types of lights. But, there are circumstances where people prefer the warm, romantic, nostalgic atmosphere provided by the light of a wax candle. Wax candles offer a soft light that flickers in a light wind. Many people who use wax candles enjoy the ritual of blowing out the candle at the end of an evening. Unfortunately, wax candles use a flame for light, and the flame requires precaution and attention to prevent harm caused by fire.

Many electric powered candles are now available as an alternative to wax candles. These candles turn on and off using switches, or activate when connected to a power source. When these candles are turned off, they switch off abruptly, like other electric appliances. The electric candles in the prior art lack the realism and appeal of real wax candles and do not provide the experience of blowing out a candle.

There remains a need in the art for an improved electronic candle that overcomes these and other disadvantages of the prior art.

SUMMARY OF THE DISCLOSURE

In one embodiment, one or more of the disadvantages in the prior art are overcome by providing a portable electronic light, which can be used as an electronic candle. The light comprises a housing, at least one light emitting diode mounted within the housing, a sensor capable of providing a signal, and a control circuit capable of receiving the signal. In this embodiment, the control circuit switches off the light emitting diode when the signal reaches a predetermined threshold value.

In another embodiment, an electronic candle comprises a candle housing, at least one light emitting diode mounted within the candle housing, and a sound sensor capable of detecting a sound within a predetermined range of frequencies, where the sensor provides a signal upon detecting a sound within a range of frequencies or a pressure, from blowing on the candle type light. A control circuit is operationally connected between the sensor and the at least one light emitting diode, the control circuit comprising an amplifier/demodulator circuit for receiving the signal from the sensor and providing an output when receiving the signal, and a switching circuit for receiving the output and switching off the light emitting diode when the output reaches a predetermined value.

In another embodiment, a method of controlling a portable electronic light comprises steps of: providing one or more light emitting diodes; providing a sensor for detecting sound or pressure; providing an amplifier/demodulator circuit and a switching circuit operationally connected between the sensor and the light emitting diodes; receiving a signal from the sensor; transmitting a first output signal from the sensor to the amplifier/demodulator circuit; transmitting a second output signal from the amplifier/demodulator circuit to the switching circuit; and switching off the light emitting diodes when the second output signal reaches a predetermined threshold value.

In yet a further embodiment, a method of using a portable electronic light comprises steps of: providing a portable electronic light comprising at least one light emitting diode, a sensor such as a sound detector for detecting a sound within a predetermined range of frequencies or a pressure transducer to provide a signal when a user blows on the candle type light, the sensor capable of providing a signal when detecting the sound, a control circuit operationally connected between the sensor and the at least one light emitting diode, the control circuit comprising a switch for activating the control circuit, an amplifier/demodulator circuit capable of receiving the signal from the sensor and providing an output, and a switching circuit receiving the output and switching off the light emitting diode when the output reaches a predetermined threshold value; using the switch to activate the at least one light emitting diode and the control circuit for controlling the brightness of the at least one light emitting diode; and blowing on the portable electronic light to generate a signal, causing the switching circuit to switch off the light emitting diode when the output signal reaches the predetermined threshold value.

Some embodiments may include a counter/oscillator circuit, operationally connected to one or more of the light emitting diodes, wherein the counter/oscillator circuit causes the light emitted from the one or more light emitting diode to increase and decrease in a pattern.

The foregoing and other aspects will become apparent from the following detailed description when considered with the accompanying drawing figures.

DETAILED DESCRIPTION OF THE DRAWINGS

As defined in this specification and the appended claims, the word 'sound' means sound waves having a frequency greater than zero Hertz, including frequencies of sound that are not audible to the human ear.

Figure 1:
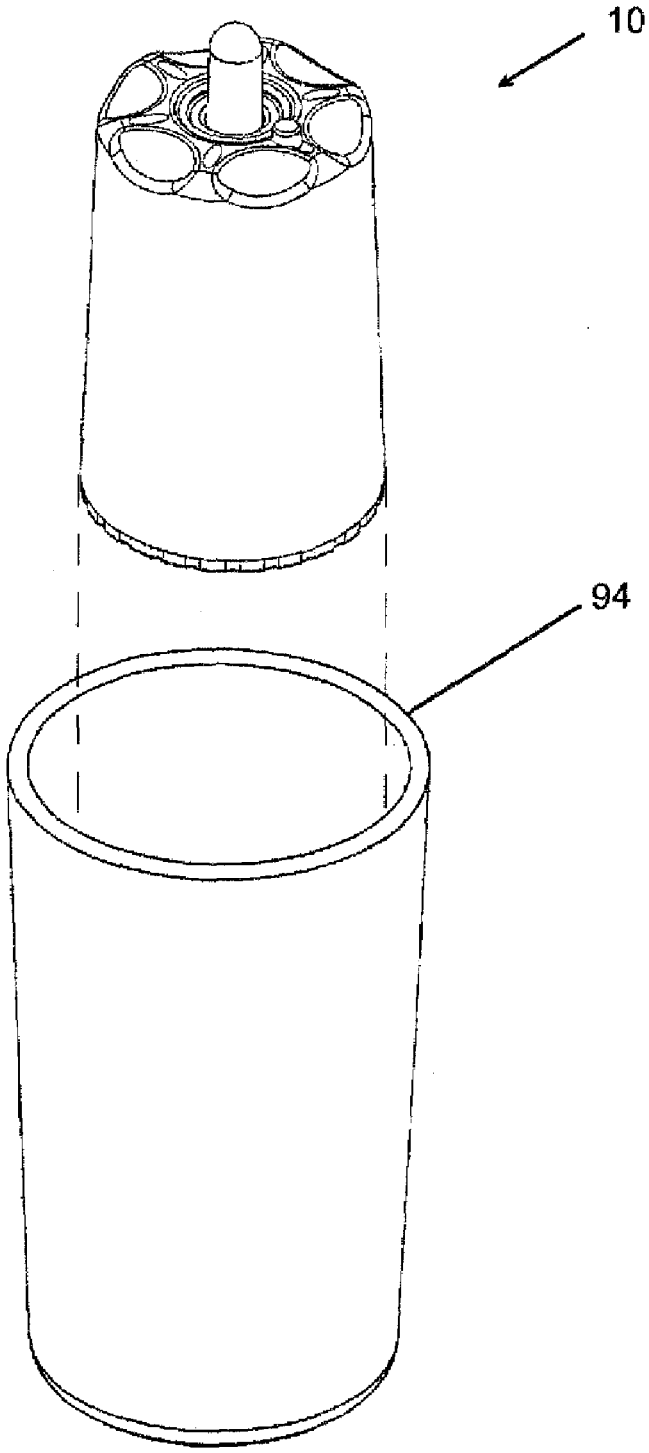
FIG. 1 is a front perspective view of a first embodiment of the electronic candle.

Referring now to FIG. 1, a portable electronic candle 10 is shown for providing an electric powered light that simulates candlelight. The light of the electronic candle 10 flickers to mimic the wavering light of a candle. An operator blows on the light to turn it off in the same manner as extinguishing a candle.

Figure 2:
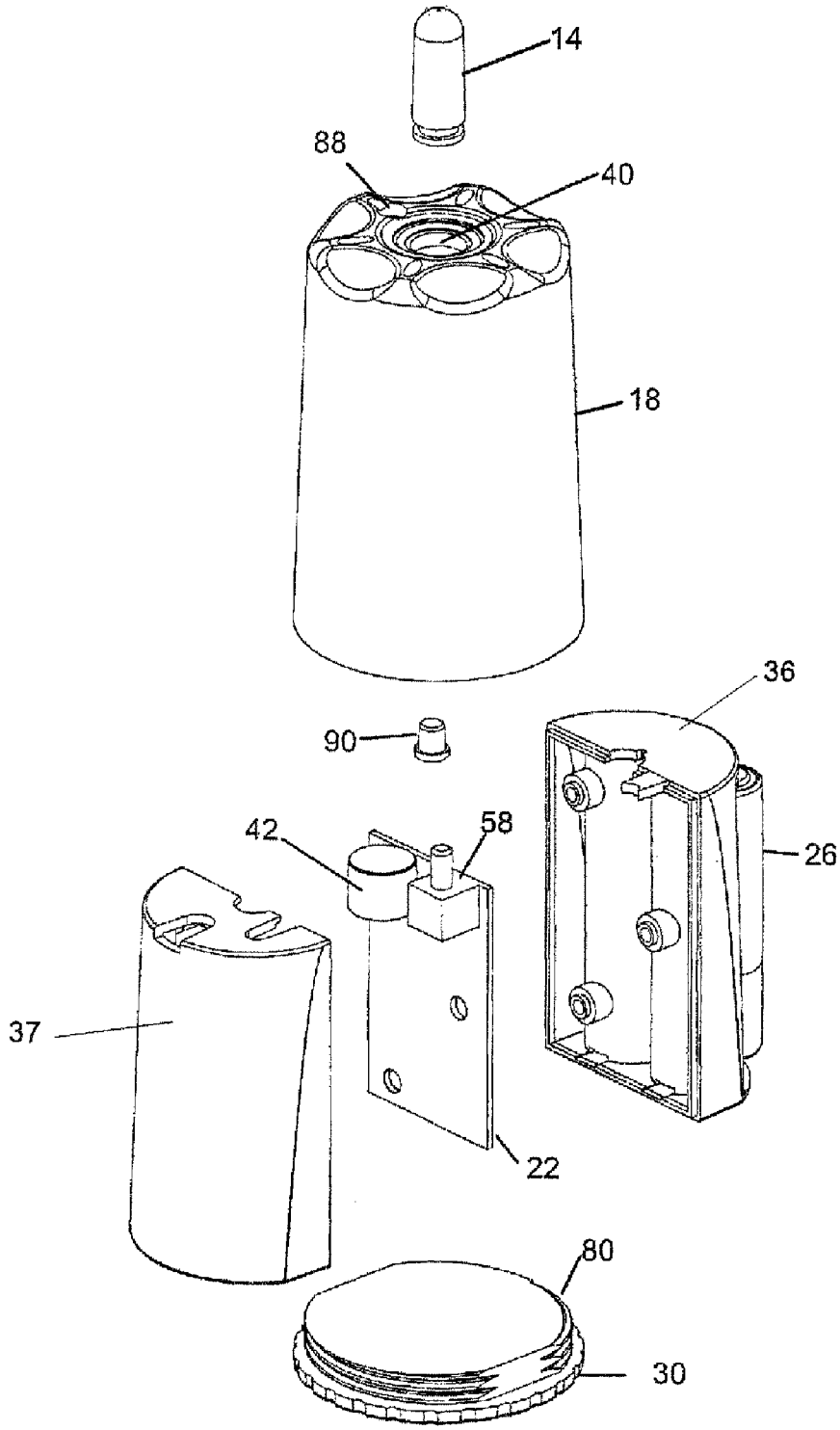
FIG. 2 is an exploded front perspective view of a first embodiment of the electronic candle of FIG. 1.

As shown in FIG. 2, the electronic candle 10 comprises a light cover 14 and a candle housing 18. The candle housing 18 accommodates a control system which may include a circuit board 22, at least one battery 26, and a bottom cover 30. The circuit board 22 is fixed within the candle housing 18, and comprises an electronic circuit providing one or more light emitting diodes, or LEDs 34, a sensor 42, and a candle control circuit 38 (see FIGS. 6 and 7).

Figure 3:
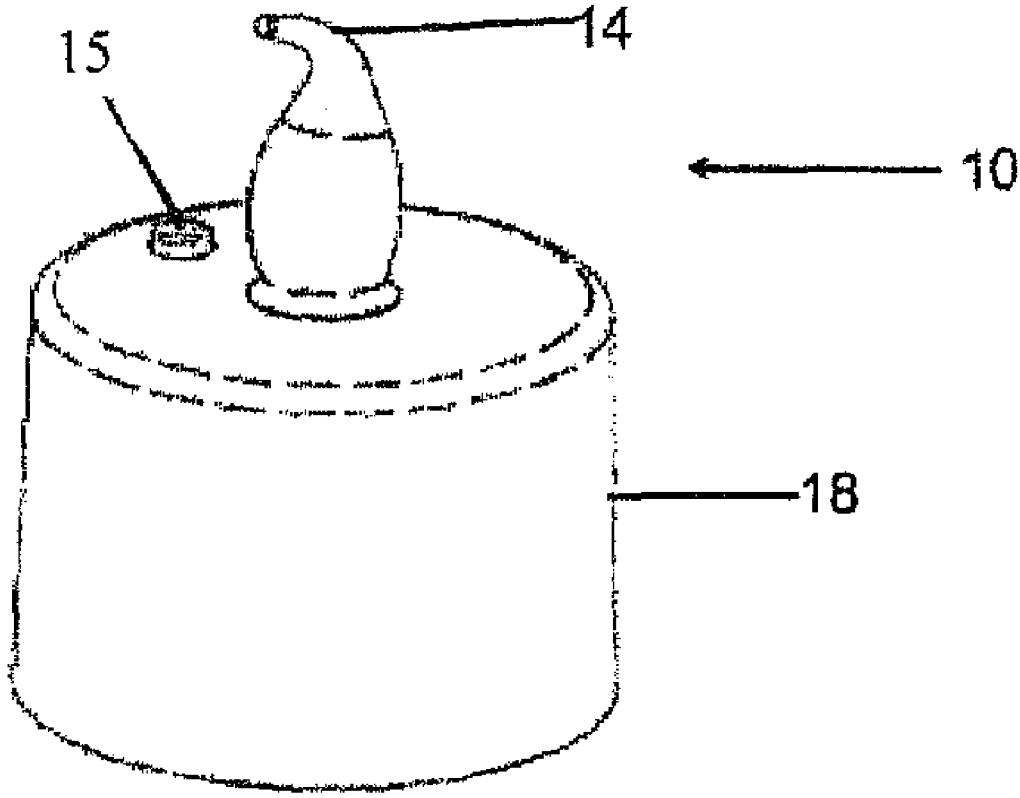
FIG. 3 is a front perspective view of a second embodiment of the electronic candle.

An alternate embodiment is shown in FIG. 3, which shows a different configuration of electronic candle 10 having a different housing 18 simulating a small candle. In this embodiment, there is also provided an on/off switch 15. Although this or other embodiments of the invention may use the sensor to allow "blowing" of the candle type light out, the switch 15 may be alternatively used, or may be the means by which the light 10 is turned on or off.

Figure 4:
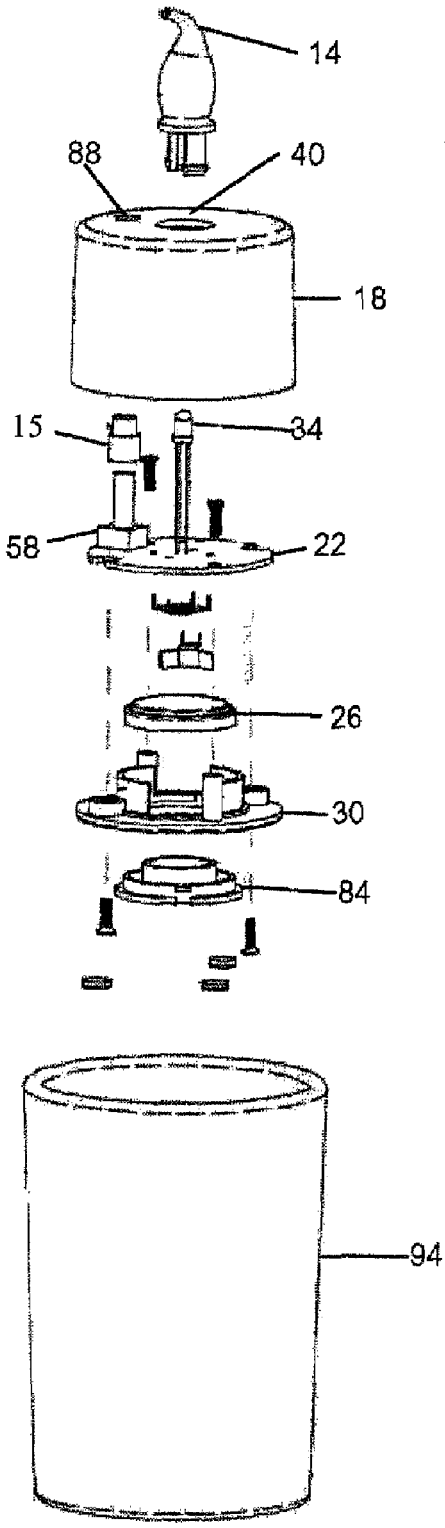
FIG. 4 is an exploded front perspective view of a second embodiment of the electronic candle of FIG. 3.

Turning back to the embodiment of FIG. 2, this and the other embodiments of the electronic candle 10 may further comprise a battery housing 36 and a circuit cover 37. In alternate embodiments, the functions of the battery housing 36 and circuit cover 37 may be integrated into the candle housing 18 and the bottom cover 30, such as illustrated by FIG. 4. In the embodiment of FIG. 4, the battery 26 nests in the bottom cover 30, and the circuit board 22 is enclosed by the candle housing 18. Thus, in the embodiment of FIG. 4, a separate battery housing and circuit cover are not provided. Any other suitable arrangement is contemplated for supporting the battery 26, the circuit board 22, and other components. It is also contemplated that the power for the light may be provided in ways other than by batteries, such as, but not limited to solar energy or household electricity (see FIG. 5).

Figure 5:
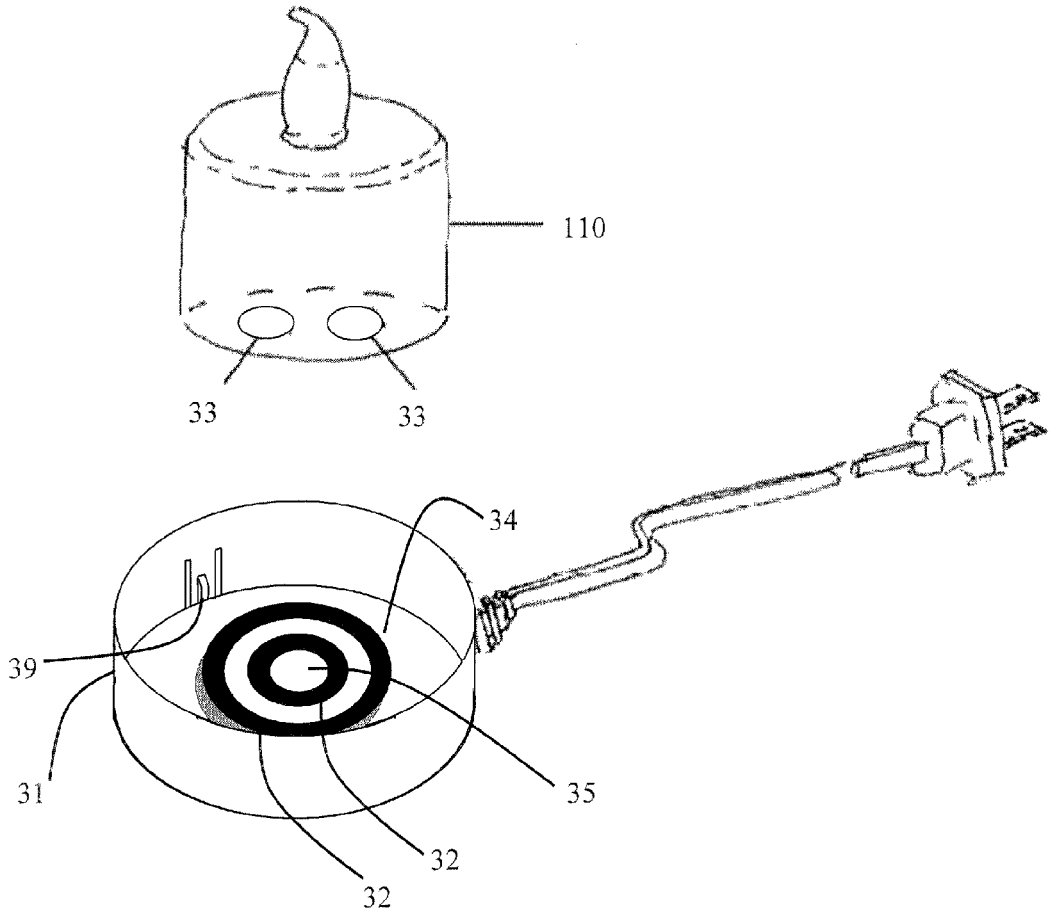
FIG. 5 is a view of another embodiment of the electronic candle.

The battery 26 may be a rechargeable battery. In an embodiment as shown in FIG. 5, an electronic candle 110 having a rechargeable battery may nest into a recharging base 31. As shown, the recharging base 31 has a recessed area 34 corresponding to the dimensions of candle 110, such that candle 110 fits within the recess 34. At the bottom of recess 34, a contact pad 35 is provided with first and second electrical contacts 32 provided therewith. The contacts 32 may be formed in a circular form, and are spaced from one another. The contacts 32 are positioned to mate with contacts 33 on the bottom of electronic candle 110, regardless of orientation of candle 110 relative to base 31. The base 31 is selectively coupled to a supply of electricity, which in conjunction with the contacts 32 and 33, provide for recharging of the battery in candle 110. A pair of protrusions or tabs 39 may be provided in association with the recess to stabilize and frictionally engage and retain a candle 110 therein.

Figure 6:
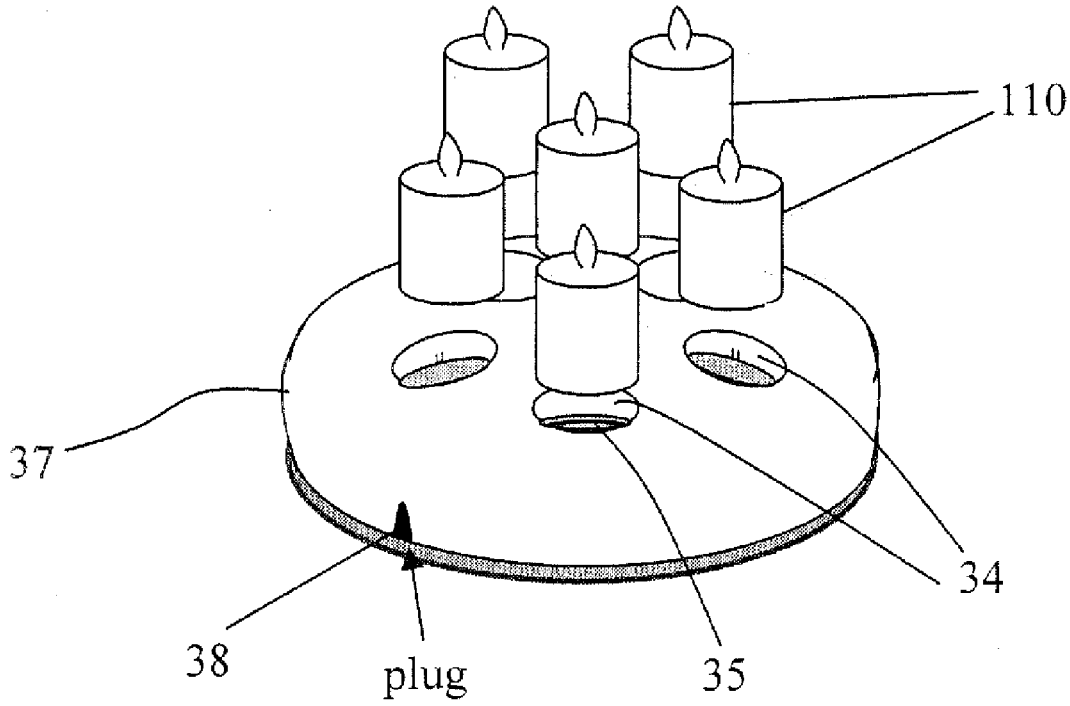
FIG. 6 is a view of a further embodiment of a recharging base for use with a plurality of electronic candles.

In FIG. 6, an alternative embodiment of a recharging base is shown, for placement and recharging of a plurality of electronic candles 110. As shown a base 37 includes six recessed areas 34 with a contact pad 35 and electrical contacts 33 provided for recharging of any individual candles 110 positioned therein. A plug in connection 38 may be provided for connecting a DC plug in. The recharging base 37 may also allow for the display of multiple candles 110 for use in a decorative array via base 37. Alternative base configurations are contemplated.

In the rechargeable battery embodiments of FIGS. 5 and 6, the base 31 or 37 may further comprise a circuit for recharging the battery, the recharging circuit including the base electrodes 32. A transformer may be used to convert household electricity to a suitable current for the recharging circuit. Typical recharging circuits and transformers are known in the art and any suitable configuration is contemplated in the present invention.

Referring now to the various embodiments of the electronic candles according to the invention, in an embodiment, a user has the ability to "blow" out the candle, in the same way as extinguishing a flame candle. To provide this function, in an embodiment, a sensor such as a sound sensor 42 is used to selectively switch off power to the one or more LEDs 34. The sound sensor 42 may be a transducer (e.g., a microphone) that converts received sound signals or acoustic energy (sensor input signal 41) to electrical energy (sensor output signal 43)). The amplifier/demodulator circuit 46 detects input sound frequencies, or the electrical sensor signals 43 from the microphone, or sound sensor 42, which are within at least a predetermined frequency range, which may be any desired range, and provides an electrical output signal 47 to the switching circuit 54, as described below.

To simulate "blowing" a candle out in the normal fashion, the control circuit 38 is designed to detect a range of frequencies produced by air blowing across the electronic candle. Thus, the predetermined range of detected frequencies has an optimal frequency at which the output signal is at its largest amplitude within a frequency range produced by air blowing across the electronic candle. In one embodiment, the control circuit 38 detects sound signals having a frequency equal to or below 20 Hertz. Frequencies below 20 Hertz are generally not audible to the human ear. In other embodiments, the control circuit 38 may be designed such that other frequencies (e.g., above 20 Hz), including audible frequencies, may be used for the input signal 41. Alternatively, the sensor may be a pressure transducer which will generate a signal upon sensing the pressure from blowing on the candle type light, such as a diaphragm or other suitable transducer.

Figure 7:
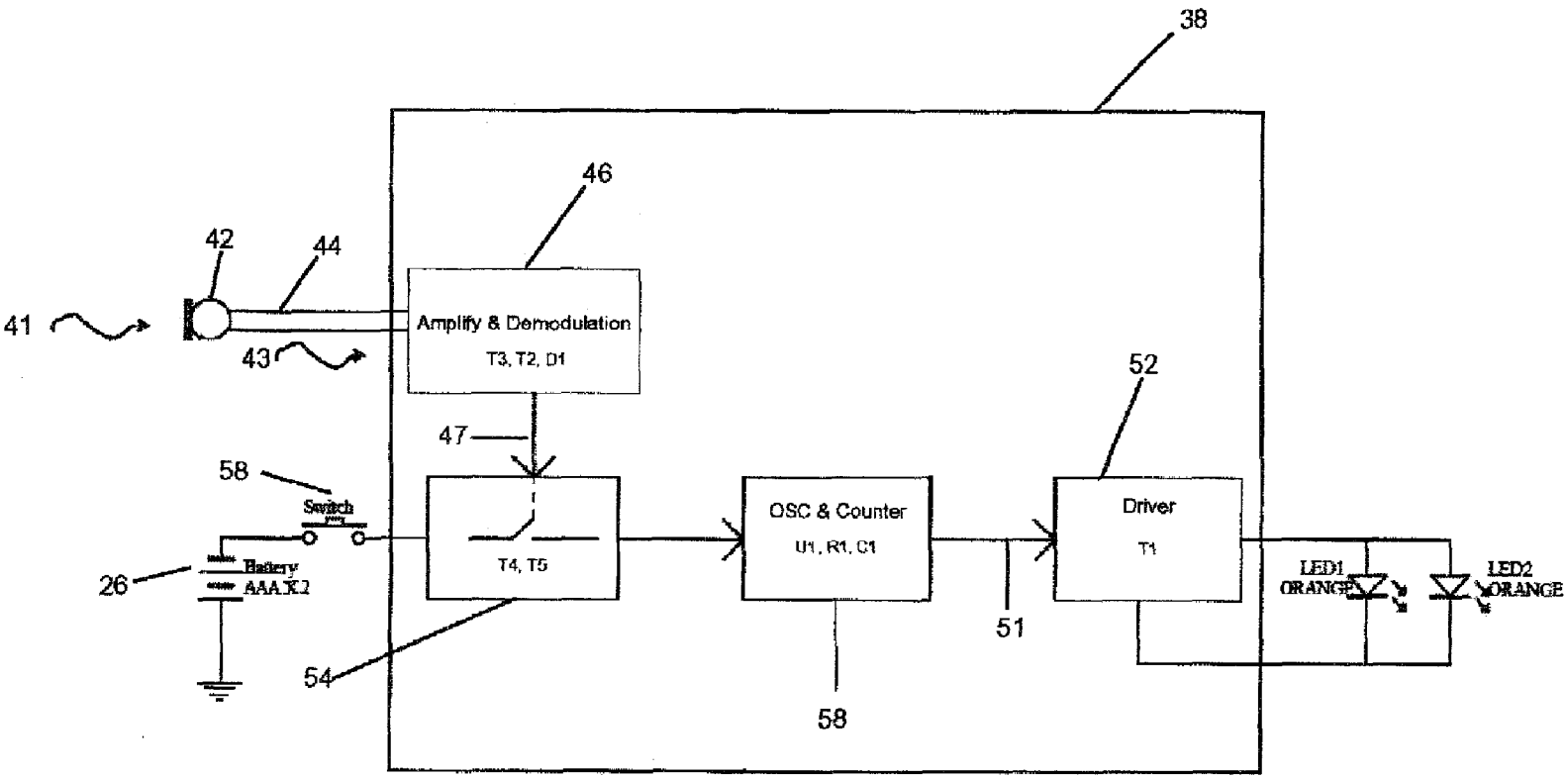
FIG. 7 is a block diagram of the circuits.
Figure 8:
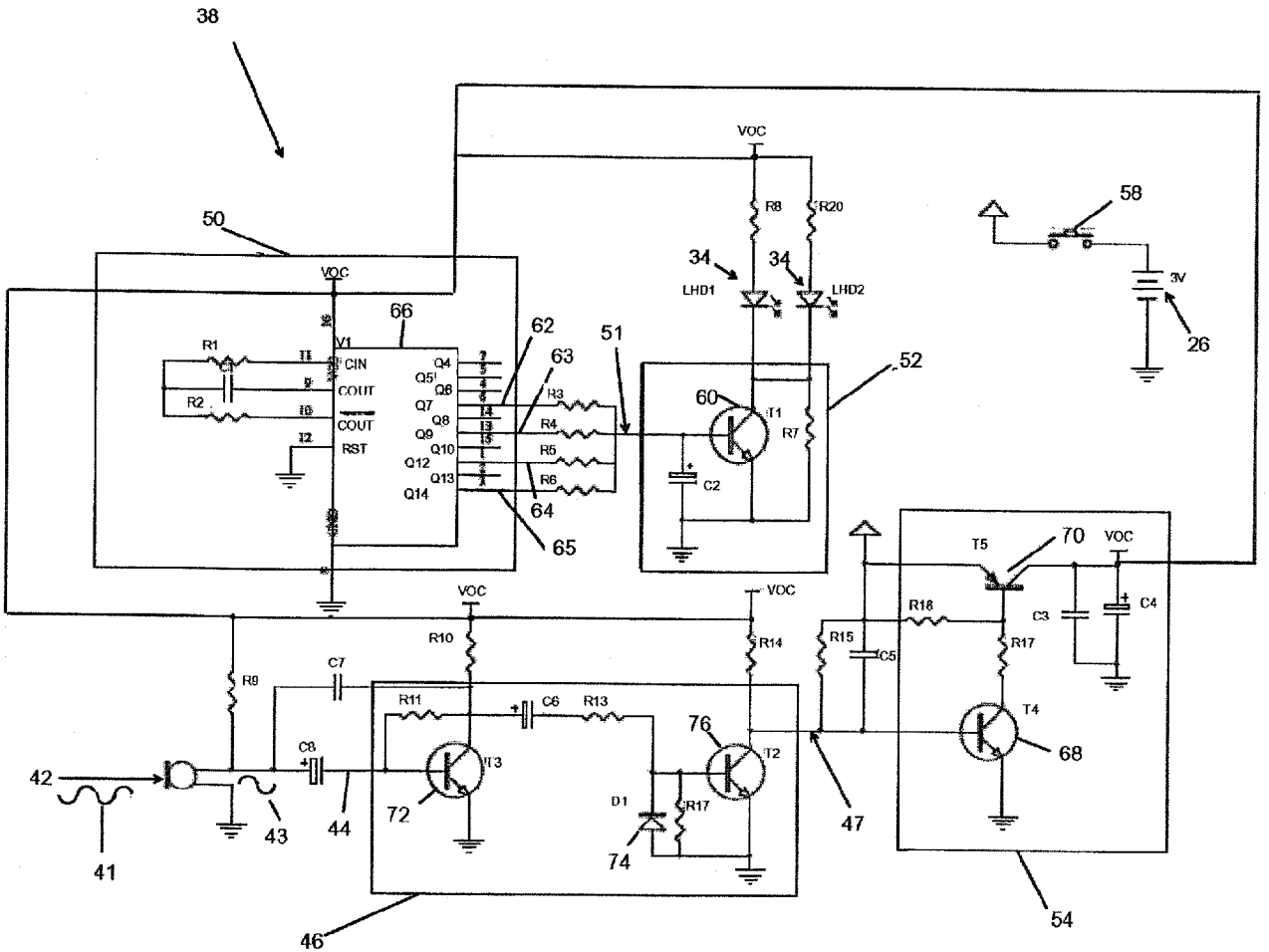
FIG. 8 is a schematic diagram of the circuits.

Referring now to FIGS. 7 and 8, the control circuit 38 comprises an amplifier/demodulator circuit 46, a counter/oscillator circuit 50, a driver circuit 52, and a switching circuit 54. A switch 58 operatively connects the battery 26 to the switching circuit 54 when activated by a user.

The candle control circuit 38 activates the LEDs 34 through the counter/oscillator circuit 50 and the driver circuit 52. The LEDs 34 (indicated by LED1 and LED2 in FIG. 8) are operationally connected to the output of the driver circuit 52. The counter/oscillator circuit 50 is operationally connected to the input of the driver circuit 52. When the output 51 (counting signal) of the counter/oscillator circuit 50 turns on the driver circuit 52, the driver circuit 52 turns on the LEDs 34. That is, the driver circuit 52 allows electric current to flow through the LEDs 34, thus causing the LEDs 34 to emit light. Similarly, when the output 51 of the counter/oscillator circuit 50 turns off the driver circuit 52, the driver circuit 52 turns off or deactivates the LEDs 34 by preventing electric current from flowing through the LEDs 34, thus causing the LEDs 34 to go dark (i.e., not emit light). In accordance with one embodiment, the driver circuit 52 includes a first transistor 60 (indicated by T1 in FIG. 8) acting as a switch that is turned on and off by the counter/oscillator circuit 50.

In the embodiment of FIG. 8, four binary output ports 62, 63, 64, 65 (indicated by Q7, Q9, Q12, and Q14 in FIG. 8) of the counter/oscillator circuit 50 are electrically connected together to form the single output 51. The counter/oscillator circuit 50 includes an integrated circuit chip 66, which includes an internal oscillator. The internal oscillator is used to clock the counter/oscillator circuit 50 when the oscillator is enabled, causing the counter/oscillator circuit 50 to generate counting signals as a counter. The binary output ports of the counter, including COUT, change their binary state as the counter/oscillator circuit 50 is clocked by the internal oscillator.

The input CIN is connected to the counter output COUT and its complement COUT' by the RC oscillating circuit comprising R1, R2, and C1. The counter outputs, COUT and Q4 to Q14, will transition when the input CIN transitions from a logic zero to a logic one. Whenever a transition of COUT (and COUT') occurs, a certain amount of time is taken to charge/discharge the capacitor C1, before the input CIN toggles. This event triggers the next transition of the oscillator, causing the COUT (and COUT') transitions, as well as updating of the counting outputs Q4-Q14. Such a self-regulating input CIN will continue to toggle, thus updating the Q4-Q14 outputs periodically.

As the counter/oscillator circuit 50 generates the counting signals, the driver circuit 52 is turned on any time any one or more of the binary output ports 62, 63, 64, 65 is in a high voltage or logic "1" binary state, causing the LEDs to light up. Similarly, the driver circuit 52 is turned off any time all of the binary output ports 62, 63, 64, 65 are in a low voltage or logic "0" state, causing the LEDs to turn off. As the counter/oscillator circuit 50 counts, none, one, two, three, or four of the binary output ports 62, 63, 64, 65 may be in a high voltage state, thereby causing the LEDs 34 to turn on and off (increase and decrease in brightness) as the counter/oscillator circuit 50 counts. Thus, the counter/oscillator circuit 50 causes the LEDs 34 to be on and off for varying periods in a pattern that simulates the flickering of a wax candle.

In the embodiment of FIG. 8, the counter/oscillator circuit 50 causes the LEDs 34 to turn on and off in the predetermined pattern of the counter/oscillator circuit 50. In other embodiments, an alternate circuit may be used to generate a random pattern of on/off signals. Alternately, a pseudo-random pattern may be utilized. Circuits for generating a random or pseudo-random counting pattern are well known in the art.

The counter/oscillator circuit 50 counts only when the counter/oscillator circuit 50 is enabled. In the embodiment of FIG. 8, the switching circuit 54 enables the control circuit 38. The switching circuit 54 is operationally connected to the counter/oscillator circuit 50 in order to enable and disable the counter/oscillator circuit 50. In one embodiment, the counter/oscillator circuit 50 is enabled when the switch 58 is used to apply power to the switching circuit 54. Such an application of power to the switching circuit 54 via the switch 58 enables the counter/oscillator circuit 50 such that the counter/oscillator circuit 50 starts counting as previously described herein.

Once enabled, the counter/oscillator circuit 50 continues to count and, as a result, the LEDs continue to flicker on and off until the counter/oscillator circuit 50 is disabled (interrupted) by the switching circuit 54, as will be described below. As shown in FIG. 8, the switching circuit 54 may include a second transistor 68 (indicated by T4 in FIG. 8) and a third transistor 70 (indicated by T5 in FIG. 8) configured to provide enabling and disabling of the counter/oscillator circuit 50.

The transistor 70 (T5) acts as an electronic switch which is controlled by the transistor 68 (T4). When the switch 58 is activated (e.g., pushed by a user), a voltage VDD is applied to the switching circuit 54 and current passes through to R15, R16, and R17 and then to the transistor 68 (T4) such that the transistor 68 (T4) enables the transistor 70 (T5) to turn on. When the transistor 70 (T5) is turned on, the counter/oscillator circuit 50 is enabled by application of a voltage VOC.

The control circuit 38 further includes the amplifier/demodulator circuit 46. The amplifier/demodulator circuit 46 is operationally connected to the switching circuit 54. When the switching circuit 54 receives an output signal 47 at or above a predetermined threshold value from the amplifier/demodulator circuit 46, the switching circuit 54 is triggered to disable the counter/oscillator circuit 50, thus resetting the binary output ports 62, 63, 64, 65 of the counter/oscillator circuit 50 to low voltage (logic "0") and preventing the counter/oscillator circuit 50 from counting. Thus, once the binary output ports 62, 63, 64, 65 are set to low voltage, the LEDs are turned off. The LEDs remain off until the operator again presses the switch 58, applying power to the switching circuit 54 to enable the counter/oscillator circuit 50 via the switching circuit 54.

The amplifier/demodulator circuit 46 only provides the output signal 47 if the sensor 42 receives a sound signal having frequencies within the predetermined range of the sensor 42. The input signal 41 is fed into the microphone, or sensor 42, which is operationally connected to an input 44 of the amplifier/demodulator circuit 46. The electrical output signal 43 from the sensor 42 is fed into the amplifier/demodulator circuit 46, which amplifies and demodulates the sensor signal to generate the output signal 47. In the embodiment of FIG. 8, the amplifier/demodulator circuit 46 includes a fourth transistor 72 (indicated by T3 in FIG. 8), a diode 74 (indicated by D1 in FIG. 8), and a fifth transistor 76 (indicated by T2 in FIG. 8) configured to provide the amplification and demodulation functionality.

In one embodiment, an appropriate input signal 41 may be generated when the operator of the electronic candle 10 blows onto the candle. Just as a user may blow on a wax candle to blow out a flame, blowing into the sensor 42 can cause the output signal 47 to be of sufficient quality (i.e., amplitude and frequency) to trigger the switching circuit 54 to disable the counter/oscillator circuit 50.

The amplifier/demodulator circuit 46 is a tuned circuit that is designed to amplify and pass at least a portion of the input signal 41, generating the output signal 47 from the input signal 41, when at least a portion of the input signal is an acoustic signal being within the predetermined frequency range. In one embodiment, the predefined frequency range is between 0.01 Hz and 5.00 Hz and is, therefore, below the normal audible hearing range of humans. It has been discovered that blowing generates sound frequencies lower than or equal to 5 Hertz. Thus, in this embodiment, when a user blows into the sensor 42 as if blowing out a wax candle flame, the input signal 41 generates the output signal 47 above the predetermined threshold value, triggering the switching circuit 54 to disable the counter/oscillator circuit 50 and turning off the LEDs 34.

The signal out of the sensor 42 is amplified by the transistor 72 (T3). The amplified signal out of the transistor 72 (T3) is used to enable the transistor 76 (T2). When enabled, the transistor 76 (T2) prevents the transistor 68 (T4) from functioning normally which causes the transistor 70 (T5) to switch off, resulting in disabling of the counting of the counter/oscillator circuit 50 and causing the LEDs 34 to turn off.

Furthermore, the amplifier/demodulator circuit 46 may be designed such that, when a user blows relatively lightly into the sensor 42, the switching circuit 54 merely degrades the counter/oscillator circuit 50. In this state, the output signal 47 generated is lower than the predetermined threshold value and not strong enough to turn the LEDs 34 totally off. When this occurs, the counter/oscillator circuit 50 outputs a logic "1" on the output 51 less frequently, thus causing the LEDs to be turned on (i.e., lit up) less frequently. This provides the effect of a candle flame that is flickering strongly or is starting to go out, such as a flame in a strong breeze. Only when the output signal 47 reaches or exceeds the predetermined threshold amplitude in the correct frequency range will it trigger the switching circuit 54 to completely disable the counter/oscillator circuit 50, thus turning off the LEDs completely. The candle housing 18 may be any suitable size and shape. In one embodiment, the candle housing 18 has a substantially cylindrical or tapered cylindrical candle shape to resemble a small tea light candle. As shown in FIGS. 2 and 4, at the top of the candle housing 18 is a first aperture 40 for the one or more LEDs 34 and light cover 14 to pass through. The light cover 14 may attach to the candle housing 18 by engaging the first aperture 40 using snap features, adhesives, welds, or other fastening techniques well known in the art. Alternately, the light cover 14 may attach to the battery housing 36 and circuit cover 37 using snap features, adhesives, welds, or other fastening techniques well known in the art.

In one embodiment, the bottom cover 30 removably attaches to the candle housing 18 so that the operator can remove the bottom cover 30 to replace the battery 26. In the embodiment of FIG. 2, the bottom cover 30 comprises spiral threads 80 on an outer edge, which engage corresponding threads on the inside of the candle housing 18. Alternately, the bottom cover 30 may be removably attached to the candle housing 18 using any suitable engaging features known in the art, such as one or more protrusions on the bottom cover 30 engaging corresponding slots or protrusions on the inside of the candle housing 18.

In the embodiment of FIG. 4, the bottom cover 30 is affixed using screws or other fasteners, or by an assembly method such as adhesive or welding. In this embodiment, the bottom cover 30 comprises a battery access cover 84 that is removably attached to the bottom cover 30. To change the battery 26, the operator removes the battery access cover 84 instead of the bottom cover 30. In the embodiment of FIG. 4, the battery access cover 84 may comprise spiral threads on an outer edge, which engage corresponding threads on the inside of the bottom cover 30. Alternately, the battery access cover 84 may be removably attached to the bottom cover 30 using any suitable engaging features known in the art, such as one or more protrusions on the battery access cover 84 engaging corresponding slots or protrusions on the inside of the bottom cover 30.

In the embodiments shown in FIGS. 1-4, the candle housing 18 comprises a second aperture 88 on the top surface near the first aperture 40. A switch button 15 operably protrudes through the second aperture 88, and is positioned to engage the switch 58. In this embodiment, to turn on the electronic candle 10, the operator presses on the switch button 15, which, in turn, activates the switch 58.

In an alternate embodiment omitting the second aperture 88, the switch 58 is placed inside the candle housing 18 near the bottom cover 30. In this embodiment, the switch 58 is positioned so that the bottom cover 30 engages the switch when the bottom cover 30 is in its fully installed position. The bottom cover 30 having a threaded engagement may be used in this embodiment, providing the operator with a rotating movement to tighten the bottom cover 30. To activate the switch of this embodiment, the operator tightens the bottom cover 30 causing the bottom cover 30 to engage and activate the switch 58.

In order to more closely imitate the appearance of a wax candle, the electronic candle 10 may be placed in a candle cup 94. The candle cup 94 may be glass, plastic, or other material. In one embodiment, the candle cup 94 is frosted to resemble a votive candle cup. The candle cup 94 may be any decorative shape or color to compliment the electronic candle 10. The candle cup 94 may also improve the performance of the electronic candle 10. The shape of the candle cup 94 may create a particular sound frequency when the operator blows into the cup. The electronic candle 10 will be more easily "blown out" when the optimal frequency of the sound sensor 42 is selected close to the particular frequency created by the operator blowing into the candle cup 94.

A method of controlling an electronic light is also disclosed, including the steps of providing one or more LEDs 34 operationally connected to a control circuit 38; providing a sensor 42, such as for detecting sound frequencies within a predetermined range or pressure signals; providing an amplifier/demodulator circuit 46 and a switching circuit 54 operationally connected between the sensor 42 and the LEDs 34; receiving a sound input signal 41 from the sensor 42; transmitting a sensor output signal 43 from the sensor 42 to the amplifier/demodulator circuit 46; transmitting a signal 47 from the amplifier/demodulator circuit 46 to the switching circuit 54; and switching off the LEDs 34 when the signal 47 reaches a predetermined threshold value.

It will be apparent to those skilled in the art that the innovative apparatus and method may be applied to other portable electronic light uses. By varying the predetermined range of input frequencies of the sound sensor 42, the LEDs 34 or other lights may be switched off, or conversely switched on, using a variety of sound inputs depending upon the requirements of the application. For example, the electronic light may be switched off using voice or other sounds.

Although the principles, alternate embodiments, and operation of the present invention has been described in detail, it is not to be construed as being limited to the particular illustrative forms disclosed. It will be apparent to those skilled in the art that various modifications of the disclosed embodiments can be made without departing from the spirit and scope of the invention as defined by the appended claims.

What is claimed is:

1. A portable electronic candle light comprising:

a housing;

at least one light emitting diode mounted within the housing;

a sensor providing a sensor signal responsive to receipt of an input signal produced by blowing on the sensor;

a control circuit capable of receiving the output sensor signal and switching off the light emitting diode when the sensor signal reaches a predetermined threshold value associated with said input signal produced by blowing on the sensor; and wherein said control circuit further comprises a switching circuit for switching off the light emitting diode when the sensor signal reaches the predetermined threshold value.

2. The portable electronic light according to claim 1, wherein the control circuit comprises:

an amplifier/demodulator circuit capable of receiving the sensor signal and providing an output signal to said switching circuit.

3. The portable electronic light according to claim 1, wherein the control circuit further comprises a counter/oscillator circuit operationally connected to one or more of said at least one light emitting diode, wherein the counter/oscillator circuit causes one or more light emitting diode to increase and decrease brightness in a pattern.

4. The portable electronic light according to claim 3, wherein the control circuit further comprises:

an amplifier/demodulator circuit capable of receiving the sensor signal and providing an output signal to the switching circuit.

5. The portable electronic light according to claim 4, wherein the switching circuit is operationally connected to the counter/oscillator circuit, and wherein the switching circuit interrupts the pattern causing the light emitting diode to decrease brightness when the sensor signal is less than the predetermined threshold value.

6. The portable electronic light according to claim 1, further comprising a switch for activating the control circuit to control the at least one light emitting diode.

7. The portable electronic light according to claim 1, wherein the housing is substantially a cylindrical candle shape.

8. The portable electronic light according to claim 1, wherein the sensor is a sound sensor and the predetermined threshold value is an amplitude of the sensor signal within a predetermined sound frequency range.

9. The portable electronic light according to claim 8, wherein the sound sensor is capable of detecting a range of frequencies less than or equal to 20 Hertz.

10. The portable electronic light according to claim 1, wherein the sound sensor is capable of detecting a range of frequencies selected from the ranges consisting of between 20 Hertz and 20,000 Hertz and greater than or equal to 20,000 Hertz.

11. The portable electronic light according to claim 1, wherein the sensor is a pressure sensor and the predetermined threshold value is an amplitude of the sensor signal created by air pressure from blowing on the sensor.

12. An electronic candle comprising:

a candle housing;

at least one light emitting diode mounted within the candle housing;

a sound sensor responsive to receipt of an input sound signal produced by blowing on the sensor within a predetermined range of frequencies, the sound sensor providing a sensor signal when detecting the sound;

a control circuit operationally connected between the sensor and the at least one light emitting diode, the control circuit comprising:

an amplifier/demodulator circuit capable of receiving the sensor signal and providing an output signal when receiving the sensor signal; and a switching circuit capable of receiving the output signal and switching off the light emitting diode when the output signal reaches a predetermined threshold value associated with said input sound signal produced by blowing on the sensor.

13. The electronic candle according to claim 12, wherein the control circuit further comprises a counter/oscillator circuit operationally connected to one or more of said at least one light emitting diode, wherein the counter/oscillator circuit causes one or more light emitting diode to increase and decrease brightness in a pattern.

14. The electronic candle according to claim 13, wherein the switching circuit is operationally connected to the counter/oscillator circuit, and wherein the switching circuit interrupts the pattern causing the light emitting diode to decrease brightness when the output signal is less than the predetermined threshold value.

15. The electronic candle according to claim 12, further comprising a switch for activating the control circuit to control the brightness of the at least one light emitting diode.

16. The portable electronic light according to claim 12, wherein the predetermined threshold value is an amplitude of the output signal within a predetermined frequency range.

17. The electronic candle according to claim 12, wherein the sound sensor is capable of detecting sound frequencies less than or equal to 20 Hertz.

18. The electronic candle according to claim 12, wherein the sound sensor is capable of detecting sound frequencies selected from the ranges consisting of between 20 Hertz and 20,000 Hertz and greater than or equal to 20,000 Hertz.

19. A method of controlling a portable electronic candle light, comprising steps of:

providing one or more light emitting diodes;

providing a sensor for detecting a user generated input signal produced by the user blowing on the sensor and producing an output;

providing an amplifier/demodulator circuit and a switching circuit operationally connected between the sensor and the light emitting diodes;

receiving an output signal from the sensor;

transmitting a first output signal from the sensor to the amplifier/demodulator circuit;

transmitting a second output signal from the amplifier/demodulator circuit to the switching circuit; and switching off the light emitting diodes when the second output signal reaches a predetermined threshold value associated with said input signal generated by the user blowing onto the sensor.

20. The method of controlling the portable electronic light according to claim 19, further comprising the steps of:

providing a counter/oscillator circuit operationally connected between the switching circuit and the light emitting diodes; and providing a counting signal from the counter/oscillator circuit causing the light emitting diodes to increase and decrease in a pattern.

21. The method of controlling the portable electronic light according to claim 19, wherein the sensor is a sound sensor which generates a signal upon detecting sound with a predetermined range of frequencies.

22. The method of controlling the portable electronic light according to claim 21, wherein the predetermined range of frequencies of the sensor is less than or equal to 20 Hertz.

23. The method of controlling the portable electronic light according to claim 19, further comprising the step of:

blowing on the portable electronic light to generate the sound signal for the sensor to receive.

24. The method of controlling the portable electronic light according to claim 19, wherein the sensor is a pressure sensor and the predetermined threshold value is an amplitude of the sensor signal created by air pressure from blowing on the sensor.

25. A method of using a portable electronic light, comprising steps of:

providing a portable electronic light comprising:

at least one light emitting diode;

a sound sensor for detecting a sound within a predetermined range of frequencies, the sound sensor capable of providing a sensor signal when detecting the sound;

a control circuit operationally connected between the sensor and the at least one light emitting diode, the control circuit comprising:

a switch for activating the control circuit;

an amplifier/demodulator circuit capable of receiving the sensor signal and providing an output signal; and a switching circuit receiving the output signal and switching off the light emitting diode when the output signal reaches a predetermined threshold value;

using the switch to activate the at least one light emitting diode and the control circuit for controlling the brightness of the at least one light emitting diode; and blowing on the portable electronic light to generate an input sound signal within a predetermined frequency range, causing the switching circuit to deactivate the light emitting diode when the output signal reaches the predetermined threshold value associated with said input signal produced by blowing on the sensor.

26. The method of controlling the portable electronic light according to claim 25, wherein the predetermined range of frequencies of the sensor is less than or equal to 20 Hertz.

* * * * *